US006581698B1

(12) United States Patent
Dirks

(10) Patent No.: US 6,581,698 B1
(45) Date of Patent: Jun. 24, 2003

(54) DRILLING DEVICE AND METHOD FOR DRILLING A WELL

(75) Inventor: Thorsten Dirks, Schüttorf (DE)

(73) Assignee: Bentec GmbH Drilling & Oilfield Systems, Bad Bentheim (DE)

( * ) Notice: Subject to any disclaimer, the term of this patent is extended or adjusted under 35 U.S.C. 154(b) by 0 days.

(21) Appl. No.: 09/763,305

(22) PCT Filed: Aug. 19, 1999

(86) PCT No.: PCT/DE99/02598

§ 371 (c)(1),
(2), (4) Date: May 21, 2001

(87) PCT Pub. No.: WO00/11306

PCT Pub. Date: Mar. 2, 2000

(30) Foreign Application Priority Data

Aug. 19, 1998 (DE) ..... 198 37 692

(51) Int. Cl.[7] ..... E21B 19/20

(52) U.S. Cl. ..... 175/52; 175/85; 166/77.52; 173/164

(58) Field of Search ..... 175/85, 52; 166/77.52; 173/164

(56) References Cited

U.S. PATENT DOCUMENTS 3,773,188 A 11/1973 Arrington
4,049,065 A 9/1977 Walter
4,128,135 A * 12/1978 Mitchhart et al. ..... 173/164
4,605,077 A * 8/1986 Boyadjieff ..... 166/77.52
4,821,814 A * 4/1989 Willis et al. ..... 173/164
4,854,400 A * 8/1989 Simpson ..... 175/85
6,085,851 A * 7/2000 Scott et al. ..... 175/7
6,217,258 B1 * 4/2001 Yamamoto et al. ..... 175/5

FOREIGN PATENT DOCUMENTS

DE 2 313 817 9/1973
DE 24 35 535 6/1975
DE 197 01 172 A1 7/1998
EP 0 243 210 10/1987

* cited by examiner

*Primary Examiner*—William Neuder
*Assistant Examiner*—Robert D Jones
(74) *Attorney, Agent, or Firm*—Cohen, Pontani, Lieberman & Pavane

(57) ABSTRACT

A drilling machine for a drilling rig and a drilling rig which can be used for exploratory drillings and producing wells, particularly in hydrocarbon deposits, both onshore and offshore. The drilling machine includes a base, on or in which a top drive is displaceable axially to the longitudinal axis of the base and a pipe-handling apparatus which is movable, especially by sliding, perpendicularly to the longitudinal axis of the base and which grips the drilling pipe. The base is pivotably and/or rotatably mounted in the region of the foot, and it is possible for a virtually continuous drilling process to be carried out using a combination of two drilling machines.

40 Claims, 16 Drawing Sheets

DRILLING DEVICE AND METHOD FOR DRILLING A WELL

This is a U.S. national stage of application No. PCT/DE99/02598, filed on Aug. 19, 1999. Priority is claimed on that application and on the following application:

Country: Germany, Application No.: 198 37 692.8, Filed: Aug. 19, 1998.

SUMMARY OF THE INVENTION

The invention relates to a drilling machine for a drilling rig and to a drilling rig which can be used for exploratory drillings and producing wells, particularly in hydrocarbon deposits, both onshore and offshore, and to a method for sinking such a well.

Modern drilling rigs according to the prior art consist of a large number of components, such as a drawworks, an iron roughneck, a working stage, a pipe-handling apparatus, a pipe rack, a crown block with a traveling block and a top drive, a pipe ramp and a catwalk for the drilling pipe, together with various auxiliary devices for handling.

Such drilling rigs have the disadvantage that they consist of a large number of components which, because of the constant changing of the drilling location of the drilling rigs, entail elaborate and costly logistics and large numbers of personnel.

European published patent application 0 243 210 A2 describes, for example, a conventional drilling machine of modular construction. It contains all components necessary for drilling machines, such as a collapsible drilling tower, which rests on a displaceable substructure by means of four legs. In its upper part it has a crown block and a top drive, together with a traveling block, and in its lower part it has a breaking and securing apparatus. Part of the drilling mast is directed by means of lifting cylinders. The absolutely necessary drawworks is arranged on the displaceable substructure and, via cables and via the crown block, forms a connection to the top drive. In addition, a pivotable pipe handling boom is provided which guides the pipe into the drilling machine.

However, this drilling machine still has a large number of components which, although of modular design, nevertheless have to be assembled and dismantled and transported from drilling location to drilling location. This requires a substantial effort in terms of personnel and logistics.

SUMMARY OF THE INVENTION

It is an object of the present invention to provide a drilling machine and a drilling rig, and also a method entailing substantial savings with regard to the equipment of the drilling rig and with regard to logistics and personnel costs.

The drilling machine according to the invention consists of a base, on or in which a top drive displaceable axially to the longitudinal axis of the base and a pipe-handling apparatus which is movable, especially by sliding, perpendicularly to the longitudinal axis of the base and which grips the drilling pipe, are arranged, the base being pivotably and/or rotatably mounted in the region of the foot.

The bearing of the foot of the base may be mounted on or below the working stage of a drilling rig in the region of the drilling cellar or on a vehicle, such as, for example, a mobile workover rig. The ground, in other words the surface of the terrain, may also be used as a working stage. With a drilling machine of this type, the main drive and handling components are advantageously integrated in one system. This also eliminates the crown bearing, traveling block and drawworks that are customary in drilling rigs according to the prior art. Similarly, the pipe ramp and the catwalk are omitted. In addition, this integrated construction allows rapid transport from one drilling location to another (rig move time) and a reduction in the numbers of drilling personnel required. It is even possible to raise and set down the drilling machine according to the invention using a dirigible with a maximum lifting power of 160 tons, as this drilling machine is much lighter than a comparable drilling machine according to the prior art. Preferably, the base is formed in a type of rocker, for example in the form of a box structure.

A further embodiment envisages that a power roughneck is arranged below the pipe-handling apparatus and comprises a holder and a breaking and securing apparatus, the holder customarily being arranged below the breaking and securing apparatus. It is particularly advantageous to arrange only the breaking and securing apparatus in or on the base and to provide the holder, for example, on or under the working stage in order thus to reduce the weight of the base. The roughneck may also be arranged on the working stage.

In a further embodiment, the drilling machine may be designed to be horizontally slidable. This has the advantage that a drilling machine, especially an erect drilling machine, can be moved out of the region of the well and, in addition, adjusted relative to any pipe stores or to the center line. In addition, pipes can advantageously be removed from a plurality of pipe stores arranged side by side.

A locking apparatus is arranged at the upper end of the base and is connected to a steel structure, preferably a tower or a mast. This has the advantage that an additional rigidity for connection or bending purposes is achieved, and the steel structure can be much more simply and flexibly constructed than customary towers or masts. A further embodiment envisages that the locking device consists of a hollow cylinder to which a flushing hose is connected and on which a valve is arranged to ensure the flushing feed. Specifically when the base is pivoted, it is advantageous to integrate the flushing feed into the locking device, so that flushing is available virtually automatically without a further working step.

A drum may be arranged on or in the base, onto which the flushing hose can be rolled up, so that the risk of fracture or other damage during the laying and removal of pipes is avoided.

An elevator is provided for raising the base from the horizontal to the vertical, which, in a particularly advantageous embodiment, consists of one or more hydraulic or pneumatic cylinders or, in another alternative embodiment, is designed as a winch. As a result, drilling at an angle of from 5° to 90° to the surface of the terrain is advantageously enabled.

The top drive of the base can be designed to be displaceable by means of a linear drive, the linear drive being arranged in or on the base. Examples of linear drives that may be used include a spindle drive, a hydraulic drive and a chain or cable hoist. Guidance can be ensured, for example, by a sliding rail, racks or guide rollers. The linear apparatus consists of drive and guide means.

This has the advantage that workover, drilling and snubbing operations (e.g. pipe laying) can be carried out.

In a further embodiment, a pipe rack is arranged within the range of the pipe-handling apparatus, the individual pipes being arranged standing in the pipe rack. This has the advantage that the base can engage independently on the pipes, without additional apparatus, and then lower them into the well by means of the top drive.

The pipe-handling apparatus as a whole or the grippers or the gripper seating are arranged to be displaceable axially to the longitudinal axis of the base, which advantageously makes it possible to handle the pipes more efficiently as, for example, when setting down the pipe or removing it from the pipe rack. A further advantage lies in the fact that, by means of such a pipe-handling apparatus, the plug and socket thread of the pipe connector can be pushed together within a permitted travel.

A further advantageous embodiment envisages that the steel structure has a working stage, the fulcrum and/or pivot point of the base being arranged above or below the working stage.

As a result of the many possible variations of the drilling machine, it becomes possible to adapt the drilling machine to local conditions at the drilling location.

A further advantageous embodiment envisages that a damping device is arranged on the base and/or the steel structure, which prevents damage being caused by uncontrolled impact when erecting the base or when locking. Thus, advantageously, damping of the load when erecting or laying down the base can be achieved.

A line for flushing is provided on or in the base, the lower connector of the line being connected to the flushing pump and the upper connector being connected via the hollow cylinder to the flushing hose. This advantageously permits the integration of an additional unit, specifically the flushing supply for the well, into the base.

In one particular embodiment, the roughneck is pivotably connected to the base by means of a hinge, which is arranged on one side of the roughneck, or, in a different embodiment, is connected to the base in such a manner that it is displaceable perpendicularly to the axis of the base. A further possibility is for the roughneck to be raised via a coupling by means of the top drive. The advantage of such an embodiment lies in the fact that the down hole equipment can be installed in the well even with the base standing vertical. The hinge may be designed, for example, as a welded hinge. The roughneck may also be mounted on the working stage in a conventional manner.

In a further embodiment of the drilling machine part of the steel structure, preferably one or more corner pillars of the steel structure, is designed as a pipe rack or as a seating for a pipe holder. This saves weight, and simplifies the device as a whole, as fewer components are needed which, overall, permits both a cost saving and the establishment of a modular system. In this embodiment, the pipe rack or seating for a pipe holder can also be mounted to rotate about its longitudinal axis. The advantageous result of this is that the loading of the magazine can take place irrespective of continuing drilling operation, and that one pipe is always located within the gripping range of the pipe-handling apparatus for removal. Also particularly advantageous is an embodiment which envisages that the drilling machine and/or the pipe rack is mounted on a vehicle or a trailer, thus significantly increasing the portability and also the flexibility of use.

The invention also covers a drilling rig having two or more drilling machines are arranged and are alternatingly moved or rotated or pivoted over the center of the well. The advantageous effect of this is that drilling times can be substantially reduced, because one drilling machine can be loaded while another drilling machine is still sinking the well. Since the loading drilling machine is not located above the well during the loading operation, the second drilling machine is able to connect the previously loaded pipe with the pipe string in the well and continue sinking the well. A further advantageous effect of this is the creation of a drilling rig which can be used for virtually continuous drilling. Also, only a minimum of drilling personnel are required, since the drilling rig according to the invention can be run almost fully automatically, particularly in the handling of the pipes, casings, etc. Drilling machines which are rotatably mounted need not be connected and can be separately driven.

A particular embodiment of such a drilling rig envisages that two drilling machines are arranged substantially symmetrically, especially with axial symmetry, to the center line, the drilling machines being connected to one another. This connection is preferably performed by a substantially kinematic chain, a claw shaft, a cable or a chain. As a result, advantageously, it is possible to reduce the energy output for setting down a pivotable drilling machine while simultaneously erecting another drilling machine, both axes of the drilling machines extending in parallel. Drilling machines which are rotatably mounted need not be connected and can be separately driven.

These advantages can also be achieved if a steel structure is arranged between two drilling machines, to which steel structure the drilling machines can be reciprocally locked, the drilling machines being connected by means of cable or chain via a return point or a return roller which is arranged in the steel structure.

An embodiment wherein a damping device is arranged on the support devices of the drilling machines or the steel structure, the damping unit for example consisting of a hydraulic cylinder and a choke, has the advantage that the load can be damped when erecting or setting down a base of the drilling machines.

The method according to the invention for sinking a well and for installing drilling pipes is a method wherein a pipe is rolled onto a base of a drilling machine, the top drive being in an upper position, and the grippers of the pipe-handling apparatus are moved into the base, and then the pipe-handling apparatus grips the pipe as soon as the latter is lying in the intended position on the base. Subsequently, the base is raised by means of an elevator from a horizontal position into a position between 5° and 90°, and in a preferred embodiment the base is locked in a steel structure, or in a mast or tower, after the vertical or nearly vertical position has been reached. During the raising of the base or after locking of the base, the top drive is screwed to the pipe by the drive shaft of the top drive and is secured and is then moved with the pipe-handling apparatus or by means of the linear drive into the upper region of the iron roughneck, the lower breaking and securing apparatus of the iron roughneck grasping the lower pipe connector of the pipe and the holder holding the string. The pipe is then screwed by means of the top drive or iron roughneck to the drilling string within the well. The pipe-handling apparatus is again moved into the base and the holder for the lower pipe, connected to the drill bit, is opened and the drilling operation is begun, the top drive being lowered in the guide means of the base. By means of such a method, drilling with an integrated drilling device can be carried out flexibly and quickly with a small drilling crew.

A further stage of the method envisages that the base is displaced horizontally between picking up the pipe and preparing it for drilling and screwing to the lower pipe, which has the advantage that a further drilling device can meanwhile continue sinking the well. A further embodiment of the method according to the invention envisages that the pipe is removed from a pipe rack, in which the drilling pipe is arranged vertically, by means of a pipe-handling apparatus, which is integrated into a drilling device as claimed in claim 1, and the pipe is then screwed to the top drive by means of the pipe connector and brought into the drilling position. The advantage of such a method lies in the fact, that, with the integrated drilling machine, the sinking of the well can take place with economy of space and energy. In a further embodiment of the method, the pipe rack, after removal of a pipe by the pipe-handling apparatus, is rotated sufficiently far about its own longitudinal axis for it to be possible for the next pipe in the pipe rack to be gripped by the pipe-handling apparatus. Thus the next pipe is automatically available for the next drilling section.

The method can advantageously also be embodied in that the drilling machine, after completion of a drilling section and release of the top drive from the drilling string in the well, is rotated about its longitudinal axis and then, after the top drive has been raised, removes a new pipe from the pipe rack by means of the pipe-handling apparatus. Thus the center line becomes free and, while the pipe-handling apparatus of the drilling machine is loading a new pipe, a second drilling machine can continue sinking the well. A further stage of the method envisages that two or more drilling machines are brought into position around a well, one drilling pipe being sunk in alternation while one or more of the other drilling machines are prepared for drilling by receiving a further pipe. As a result of this alternating interplay of two or more drilling machines, a high level of drilling progress per unit time can be achieved and cooling down times can be reduced, A further embodiment of the method according to the invention envisages that, for the installation of drilling pipes, a pipe is removed from a pipe rack while the pipe rack is simultaneously being charged with further pipes, which has the advantage that the cooling down times can be even more greatly minimized, because the charging of the pipe rack can take place independently of the sinking of the well. This also reduces the drilling down times.

The method according to the invention can of course be employed, by reversing the sequence of method stages, to remove pipes, in which case hoists may also be employed which are arranged below the top drive and independently enclose the pipe (the tool joint). Tractive force is not exerted via the threaded connection as a result.

Instead of pipes, casings, sections, tubing, etc. may be used. The pipe rack may be designed as a pipe bin or finger stage. A pipe frequently consists of a plurality of individual drill rods (double or triple stands), which are screwed together even before being placed in the pipe rack. However, a pipe may also consist of only one drill rod (single stand).

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
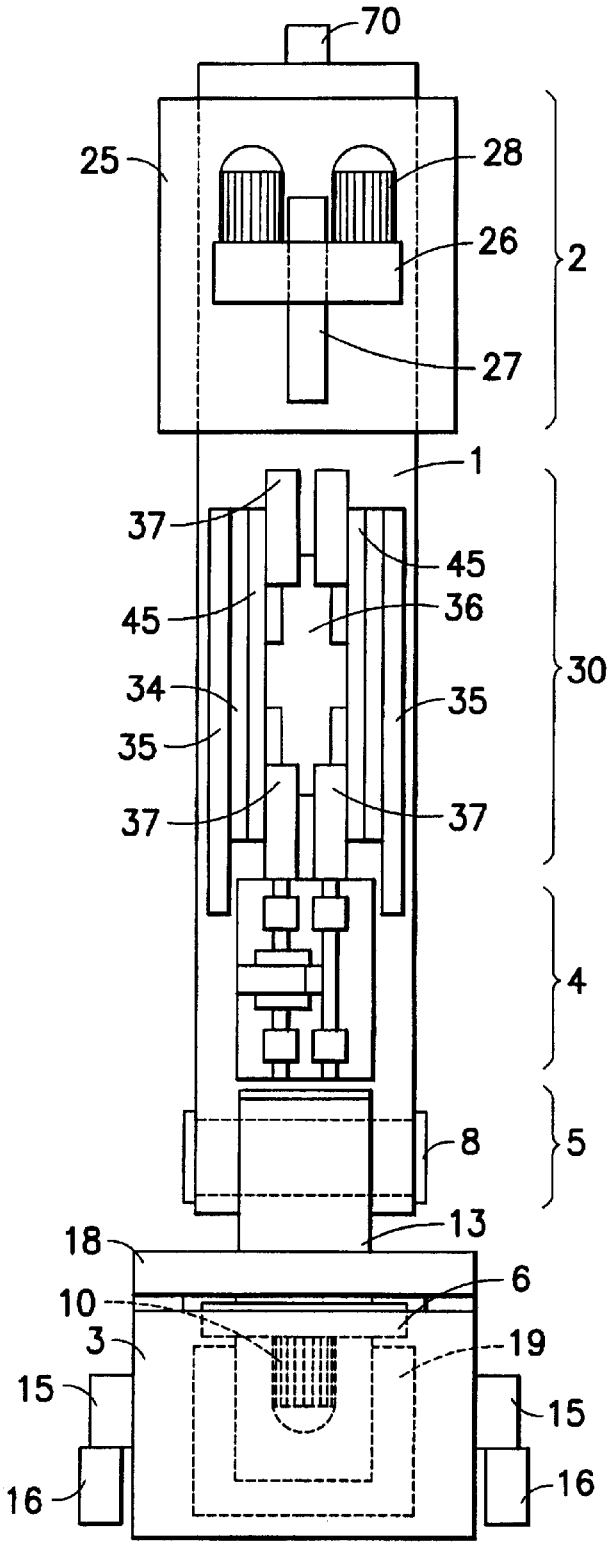
FIG. 1 shows the front view of a base with the individual components.
Figure 1A:
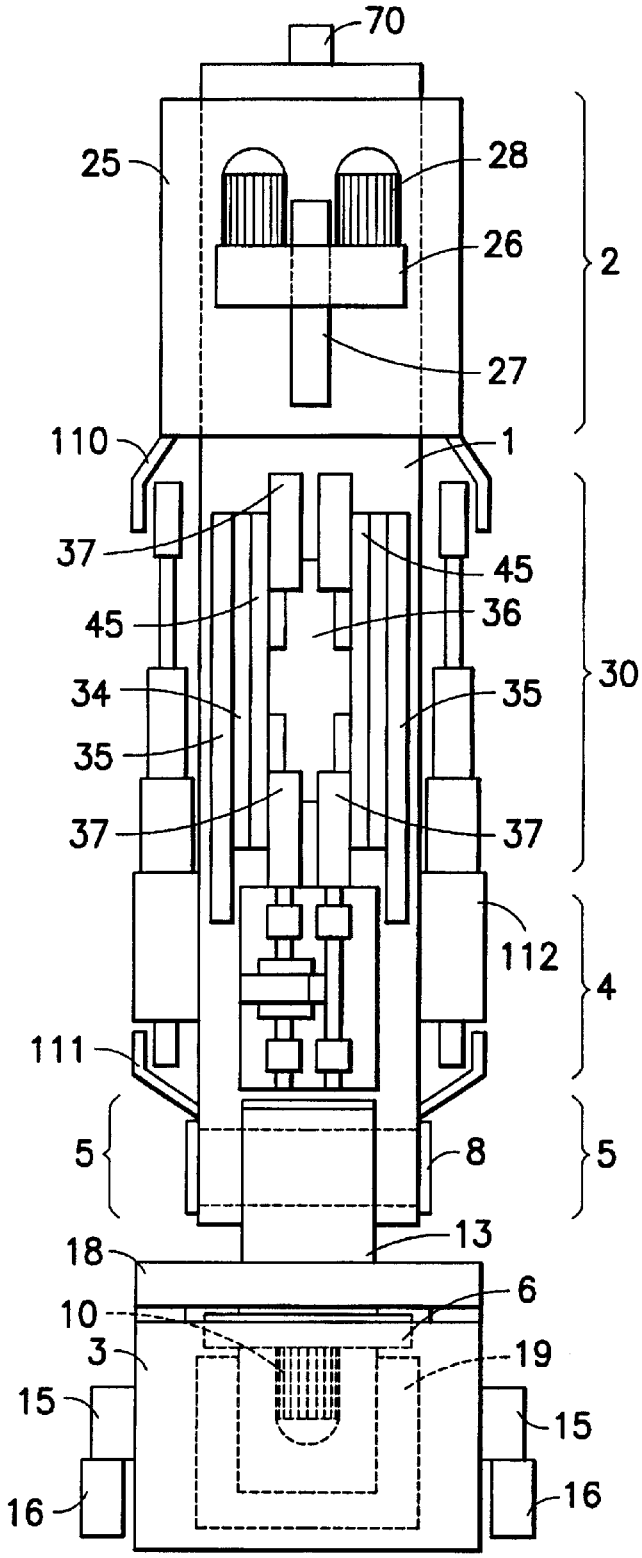
FIG. 1*a* is a view as in FIG. 1 showing one embodiment of a linear drive.

FIG. 1 shows a base 1 designed as a "rocker" into which a top drive 2, a pipe-handling apparatus 30 and an iron roughneck 4 are integrated, the latter comprising a breaking and securing apparatus 11 and a holder 12, an optional possibility being to arrange the holder outside, for example below, the rocker 1 on a working platform, for example in order to save weight. In this example of embodiment, the rocker 1 can be transferred from the horizontal to the vertical position by means of a swivel apparatus 5 and is additionally mounted to rotate via a live ring 6, which can for example consist of a toothed wheel, about the longitudinal axis in a vertical position of the rocker. Such a supporting apparatus may, of course, also be designed only with a swivel apparatus 5 or a live ring 6. The connecting element 13 is connected at its upper end to the base 1 via a swivel bearing with a bolt 8, and is seated at the bottom on the live ring 6. In this arrangement, the upper part of the connecting element 13 is designed as an eye in which the bolt 8 of the swivel bearing is mounted. Above the movement apparatus 3, the receiving plate 18 for the elevator (not shown) is connected to the live ring 6 or to the connecting element 13, so that the receiving plate 18 is also moved during a rotational movement of the drilling machine.

The top drive 2 is provided, in this example of embodiment, with two motors 28 which introduce the torque into the drilling pipe via the top drive 2. The top drive 2 is moved parallel to the longitudinal axis 20 of the rocker 1 from top to bottom or from bottom to top, preferably by means of a linear drive which is integrated into the rocker 1.

Figure 2:
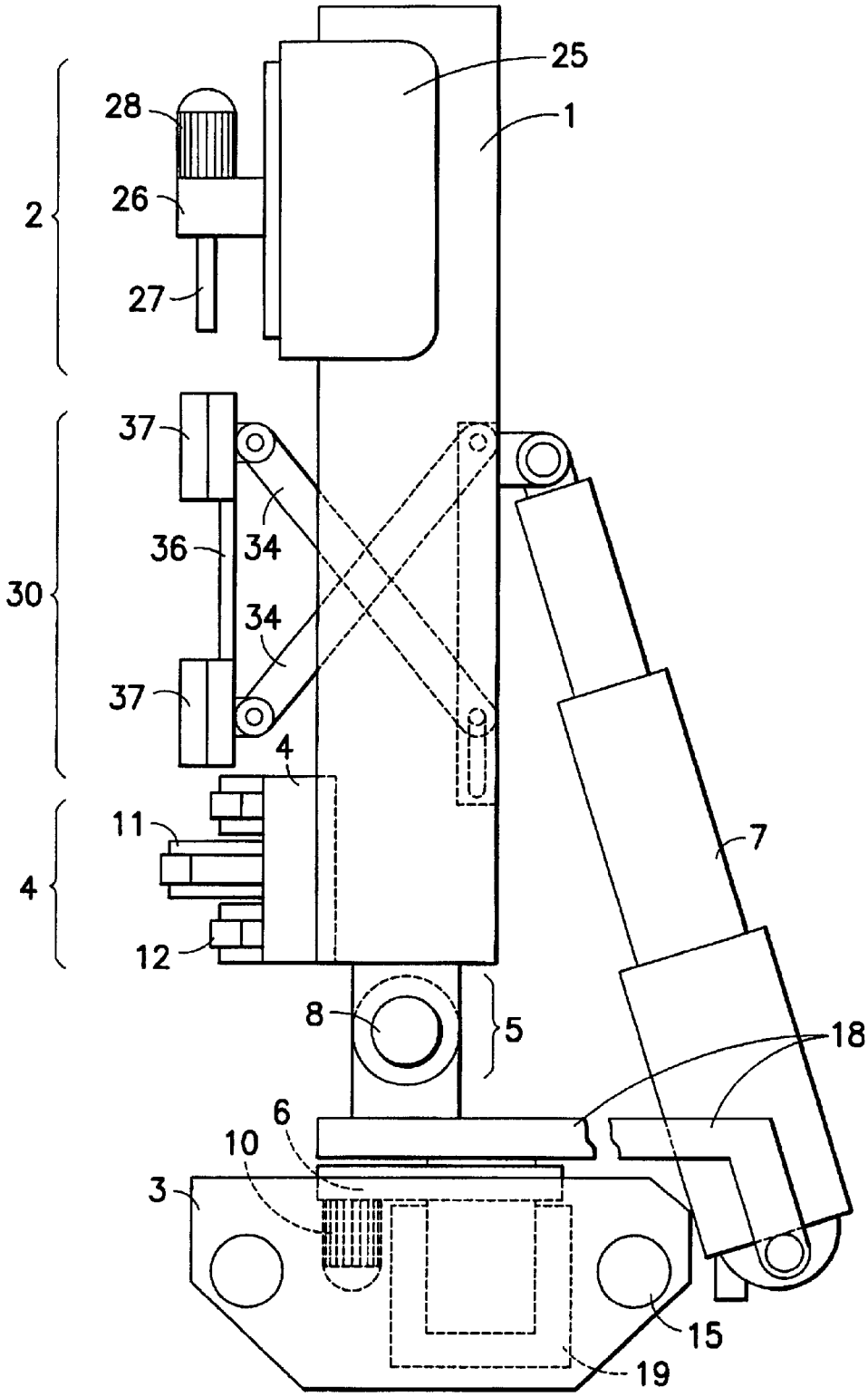
FIG. 2 shows the base in a lateral view.
Figure 2A:
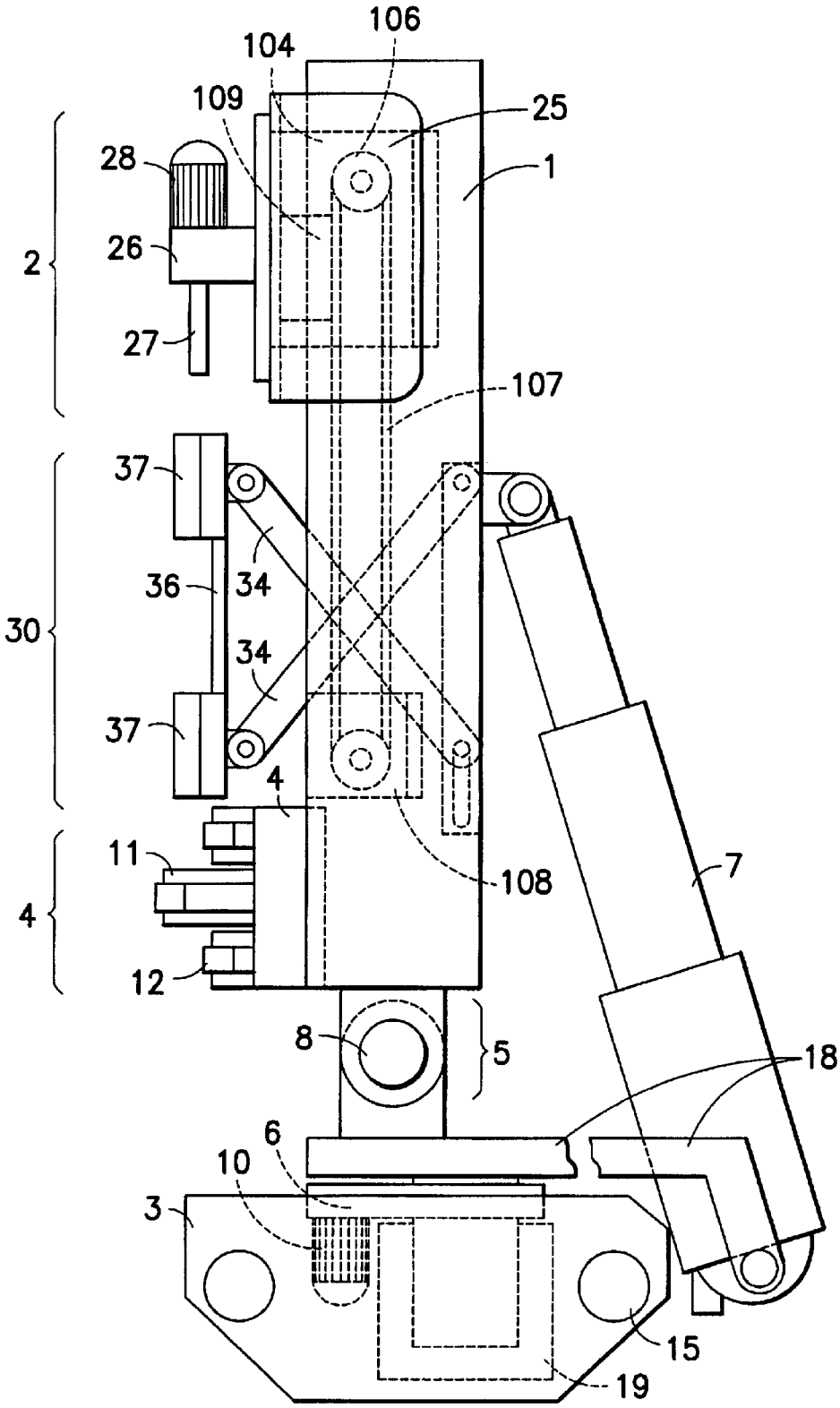
FIG. 2*a* is a view as in FIG. 2 of another embodiment of the linear drive.
Figure 2B:
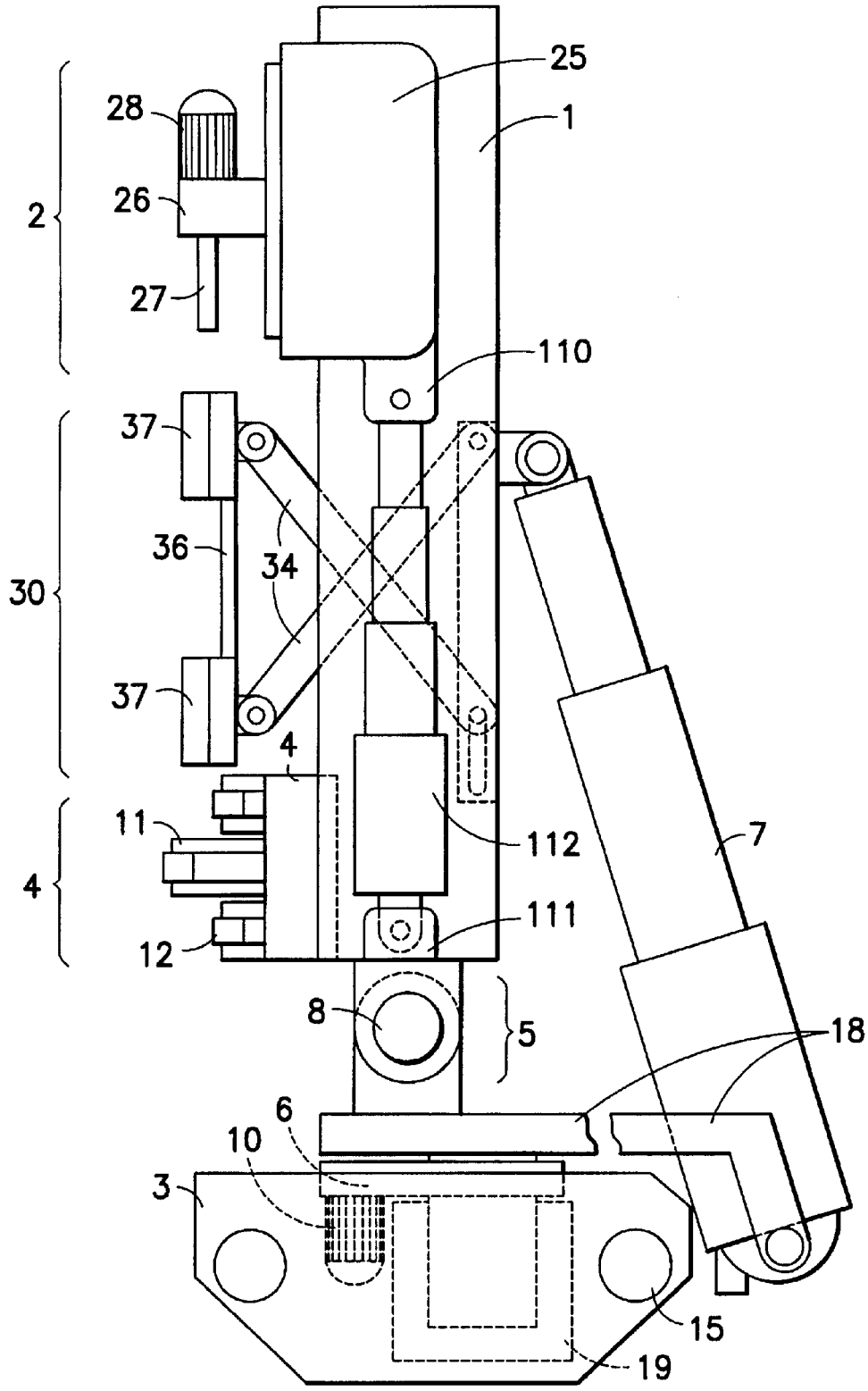
FIG. 2*b* is a view as in FIG. 2 of the embodiment in FIG. 1*b*.
Figure 2C:
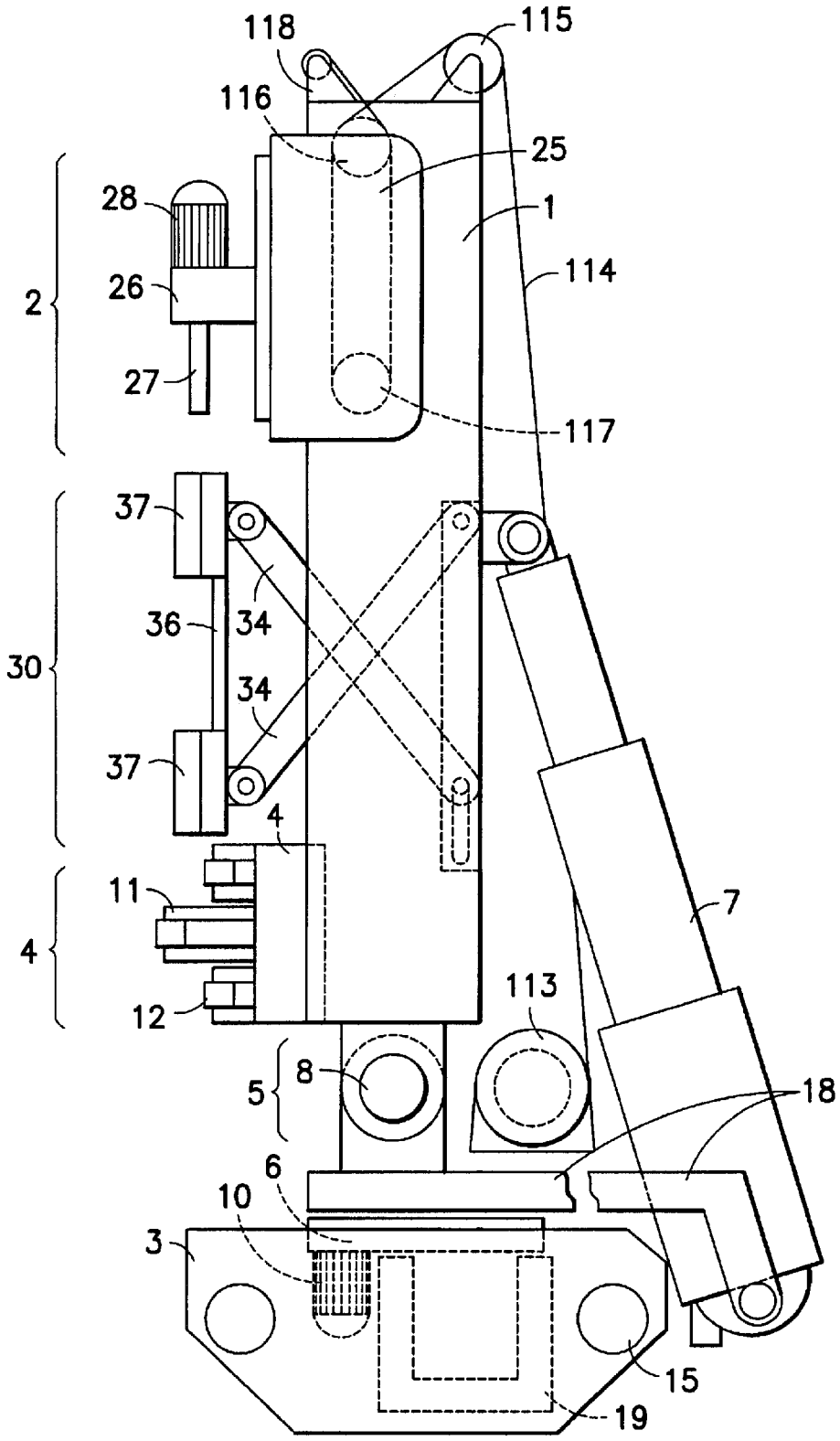
FIG. 2*c* is a view as in FIG. 2 of a further embodiment of the linear drive.
Figure 3:
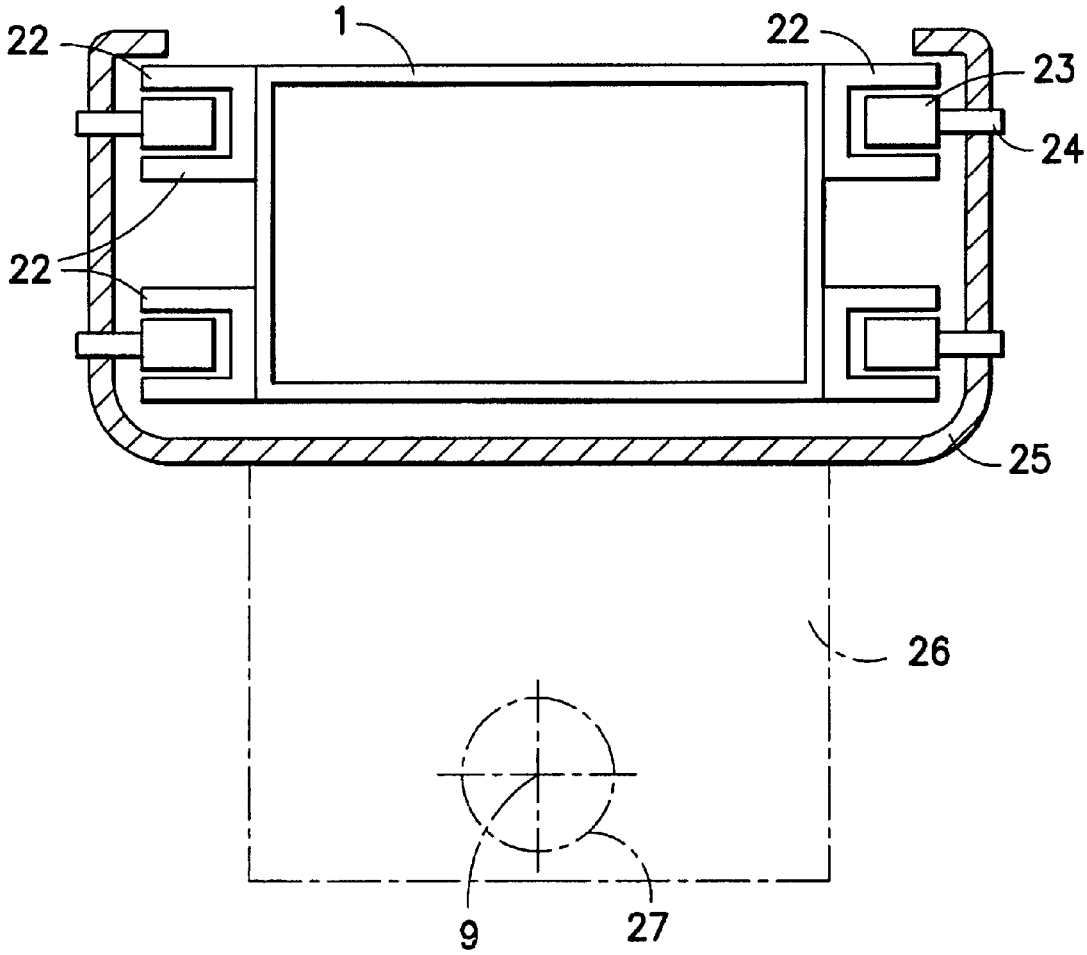
FIG. 3 contains a plan view of a guide means of a top drive.
Figure 3A:
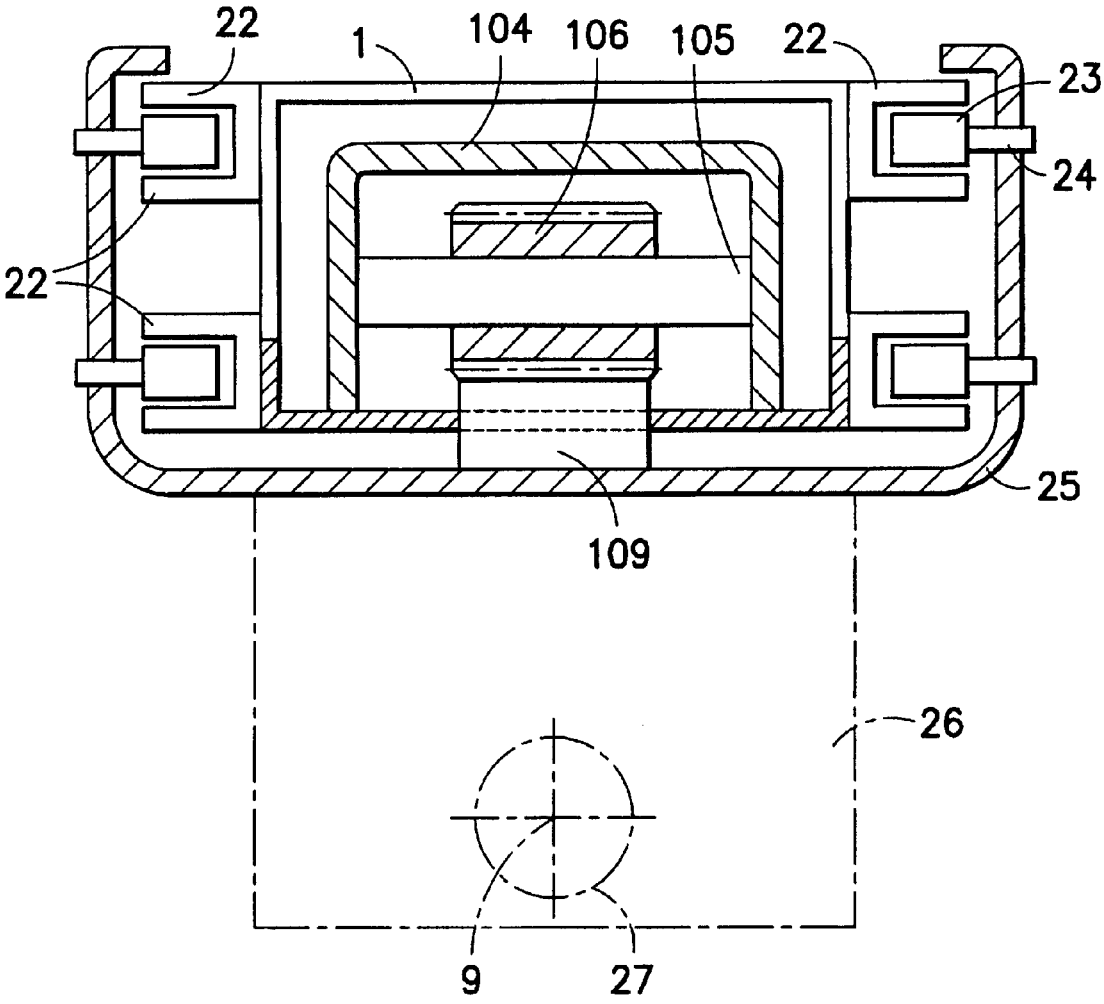
FIG. 3*a* is a view as in FIG. 3 of the embodiment in FIG. 2*a*.

FIGS. 2*a* and 3*a* show a linear drive or linear apparatus which is a chain drive system. The top drive system which is connected to the swivel apparatus 5 is moved in the vertical direction in this embodiment. The swivel apparatus 5 is equipped with a shaft 105/sprocket 106 combination. The lower part of the base is equipped with a similar device. A chain is installed between both sprockets 106. The support 104 is fixed with the base 1. The top drive system 26, 27, 28 is connected via the receiving plate 25 and the support 109 to the chain. The lower sprocket/shaft combination is driven electrically or hydraulically with the motor equipped with a gear box unit. The embodiment shown in FIGS. 1*b* and 2*b* is a hydraulic linear drive. The receiving plate 25 is connected with a device 110 and the base 1 is additionally equipped with the device 111. The receiving plate 25 is lowered or raised with two hydraulic cylinders 112 on the right and left side of the base 1. The hydraulic cylinders are powered by a hydraulic power unit which is not illustrated in the drawing. The hydraulic cylinder is preferably a telescopic type which increases the performance of the overall drilling device in general. FIG. 2*c* shows an essentially conventional system for linear drive wherein the receiving plate 25 is lowered or raised with a winch 113 in conjunction with a drilling line 114. The top of the base 1 is equipped with a sheave 115 and a deadline anchor 118. The plate 25 is equipped with a traveling block 117. The base 1 is equipped with a crown block 116. Depending on requirements, 6, 8, 10 or more lines are used to handle the required loads. Other mechanical solutions could be taken into consideration as well. Vertically installed spindle which are provided in the upper and lower position could be used as well. The spindle rotates via an electric, pneumatic or hydraulic motor. The rotor bearing of the spindle is connected to the plate 25 for the lowering and raising of the top drive system.

Fixedly connected to the upper end of the rocker 1 is an entry lid 70 for a locking apparatus 60 by means of which the rocker can be engaged and locked into a securing apparatus (not shown) of a steel structure. Optionally, a flashing feed apparatus may also be integrated into this locking apparatus. If the drilling machine is used without the steel structure, as for example in the case of shallow wells, the locking apparatus 60 and the entry lid 70 are dispensed with.

The drilling machine is seated on a movement apparatus 3, which can be displaced by means of rollers 15 on guide means or rails. 16.

In this example, the top drive 2 is guided externally on the rocker by means of a receiving plate 25, on which the top drive housing with the top drive 2 is fixed. The drive shaft of the top drive is designated 27. As an alternative (not shown) the guide means for the top drive may also be arranged within the base.

FIG. 2 shows the lateral view of a rocker 1, of rectangular design in this case, in which the top drive 2 is mounted externally on the rocker by means of a receiving plate 25, to which rocker the top drive housing 26 with the top drive 2 is fixed. A base or rocker which is rounded at the corners may of course also be used. In the region of the pipe-handling apparatus 30 are the grippers 37 whereby the pipe is gripped. The grippers are connected to one another by means of a gripper seating 36. The gripper seating 36 may be displaceably arranged. The iron roughneck 4 is integrated in the lower region of the rocker 1. In a further embodiment of the rocker 1 (not shown) no iron roughneck is integrated; in this alternative embodiment, the latter is on the working stage. A swivel apparatus 5 is shown at the foot of the rocker 1 and is seated on a rotating apparatus, designed in this example as a live ring 6, which is driven by the motor 10. The rotating apparatus is mounted in a swivel bearing 19, in this case a roller bearing (ball/roller bearings and ball bearings are also possible). The live ring 6 is seated in a movement apparatus 3, which is designed as a linear guide means and by means of which the whole rocker 1 can be displaced forward or backward (to the right or left in FIG. 2), in other words over or away from the well. Depending on application requirements, the base 1 can also be operated only with a rotating apparatus or a movement apparatus or a swivel apparatus or a combination of two of these apparatuses.

The receiving plate 18 for the elevator 7, which in this case is designed as a telescopic cylinder, serves to retain it. The elevator 7 is articulated on the base at the top (true angle not shown). The pipe-handling apparatus 30 has been shown in simplified form in this example. Thus, an upward and downward movement cannot be performed.

Guide rails 22 are provided which serve to receive the top drive receiving plate 25. This receiving plate 25 consists, in this example, of a bent structure formed from a U-shaped folding section in which the roller axles 24 for the guide rollers 23 are laterally mounted. Also mounted on the receiving plate 25 are the top drive housing 26 with the drive shaft 27 of the top drive. This shaft is above the center of the well 9 during drilling.

The guide rollers 23 are mounted by means of roller bearings and serve to guide the receiving plate 25 in the linear axis.

Figure 4:
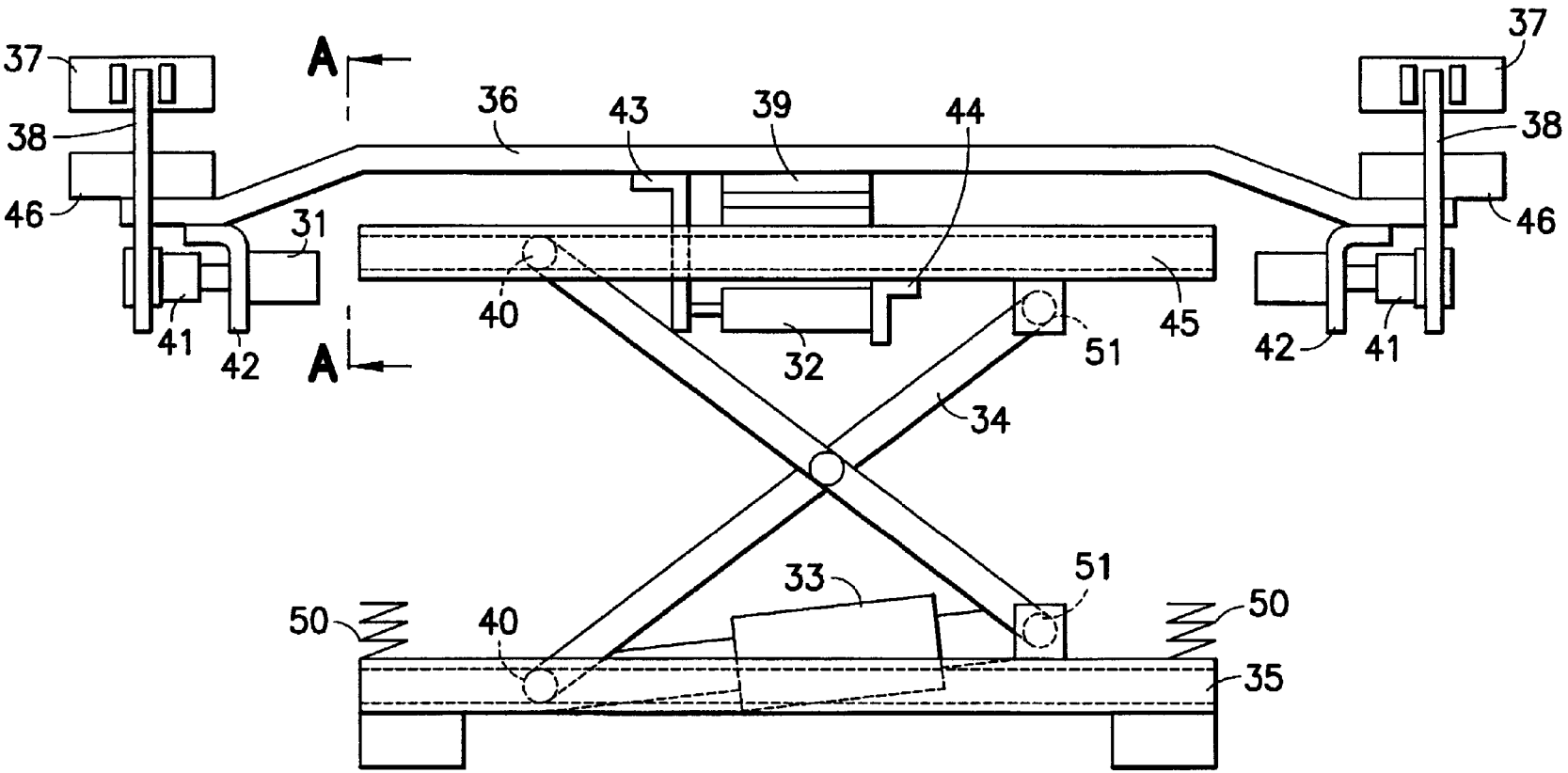
FIGS. 4 and 6 show, respectively, the lateral and plan views of a pipe-handling apparatus.
Figure 5:
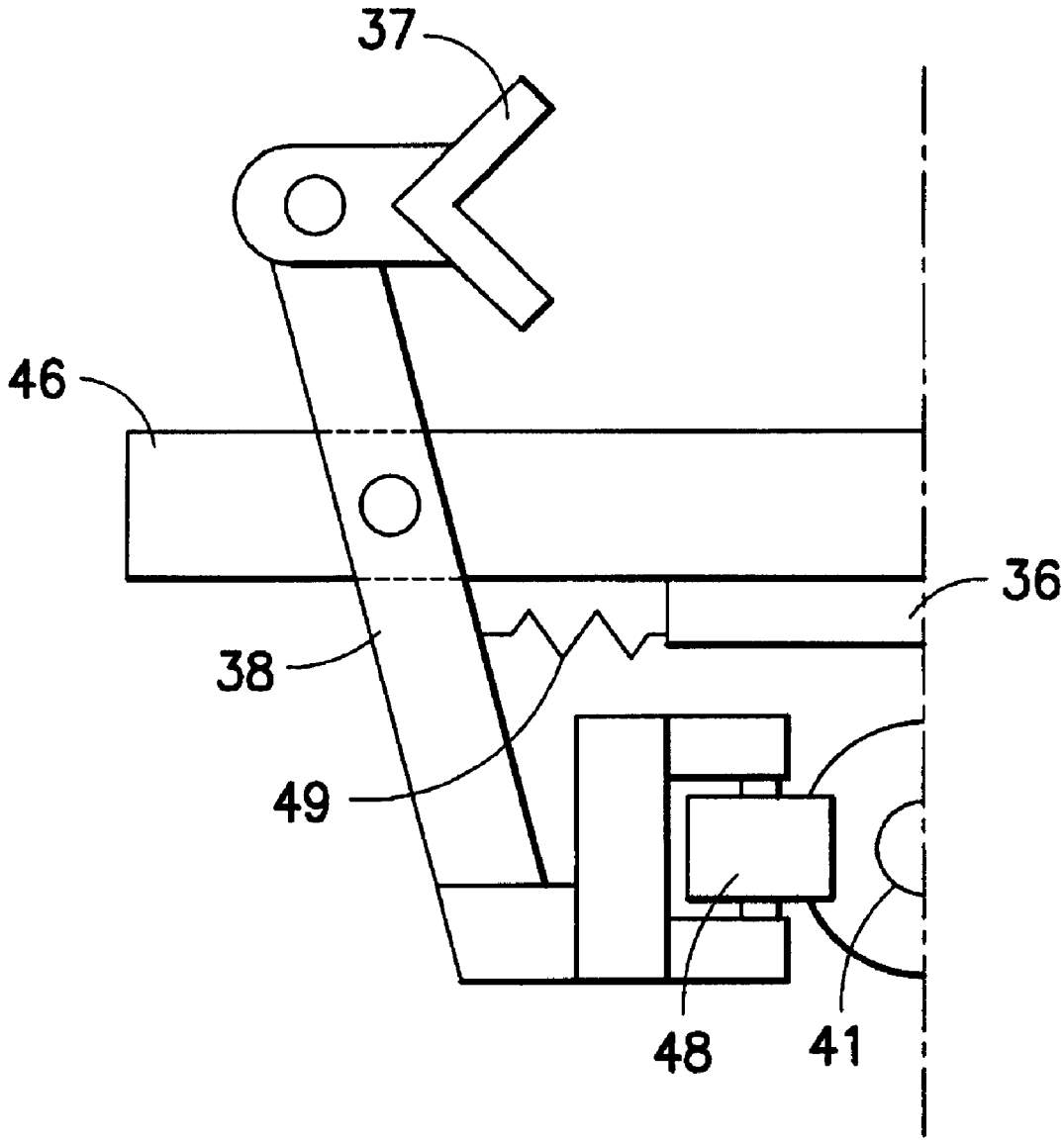
FIG. 5 shows the lateral view of a gripper unit along the line A A' of the pipe-handling apparatus in FIG. 4.
Figure 6:
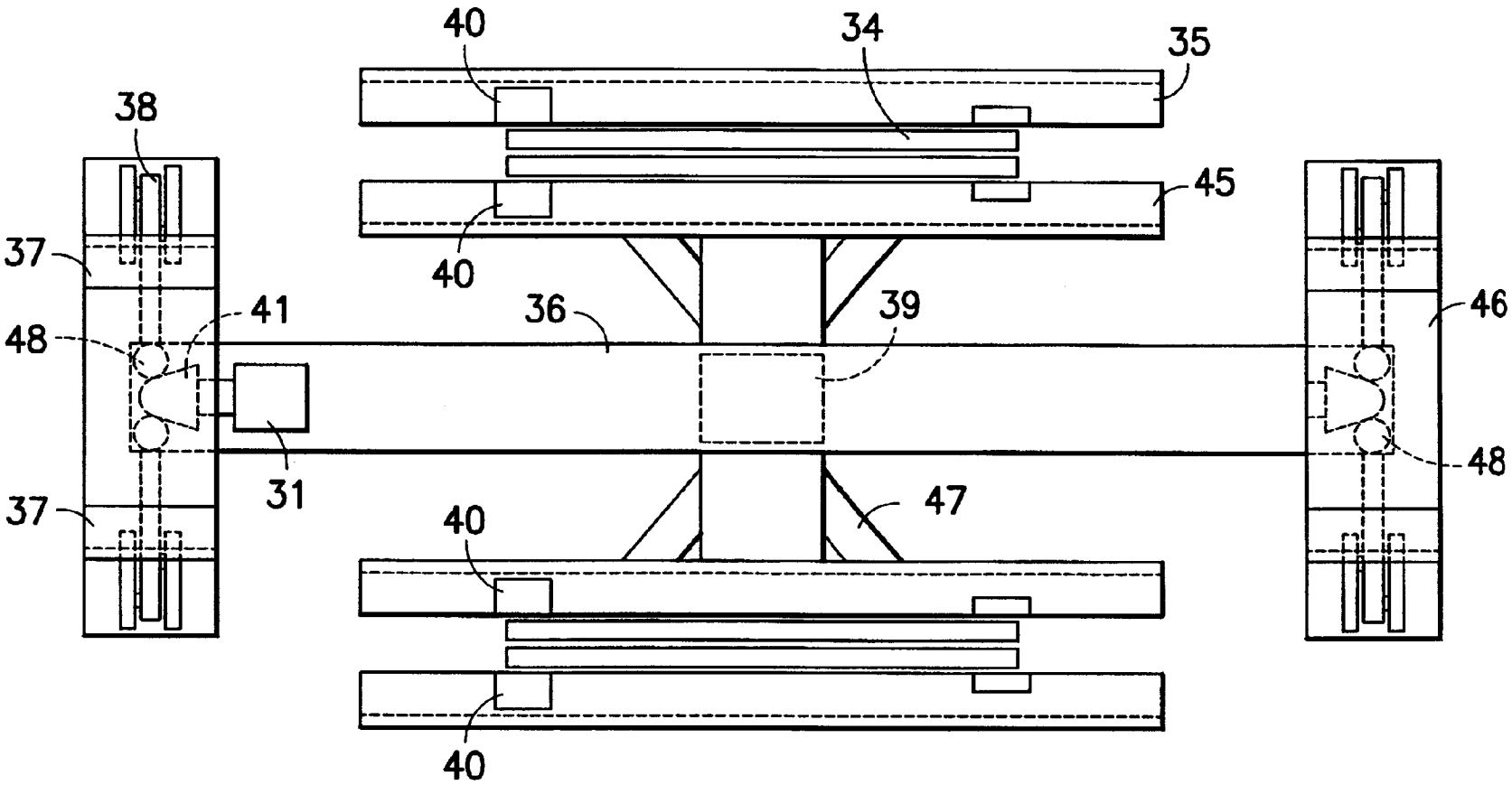

With the aid of a linear drive (not shown), a linear movement of the receiving plate can be made possible by means of the arrangement referred to above. The linear drive may be provided either by chains or by cables. A further possibility would be an elevator for the receiving plate 25 with the top drive housing 26 by means of a hydraulic cylinder, which also moves the receiving plate 25 axially relative to the longitudinal axis of the base 1. FIGS. 4, 5 and 6 show an example of embodiment of a pipe-handling unit. The pipe-handling apparatus 30 consists of tongs 34, in order to enable lifting out of the base 1, a linear guide means 39 on the upper skid 45 and two gripping units, consisting in each case of the gripper seating 36, the gripper 37 itself, a gripper arm 38, an expansion cone 41, a receiving plate 46 and rollers for the gripping arm 48.

In this example of embodiment, the lifting movement is enabled by a tongs system. The tongs 34 are fixed on one side by fixed bearings 51. Rollers 40 are secured on the other side of the tongs 34 and lie in guide means of the base skid 35 or upper skid 45. The tongs 34 can be moved together or apart by means of a hydraulic cylinder 33, which is installed in the lower tongs region between the axes, specifically on one loose and one fixed side of the tongs 34. In order to facilitate the lifting movement from bottom dead center, this movement is supported by compression springs 50. The kinematics of the lifting device can also be designed so that lifting out from dead center is avoided. This can be achieved, for example, in that the end position selected is not the closed position of the tongs 34 substantially parallel to the cylinder but a residual angle of, for example 15° remains.

In order to facilitate the setting-down of the pipe 78, the gripper seating 36 is arranged to be linearly mobile on the upper skid 45. This gripper seating 36 can be moved parallel to the axis of the base 1 via a pneumatic or hydraulic cylinder 32, which is secured on the upper skid by means of a mounting 42. In addition, the linear guide means 39 provides the possibility of introducing the pipe into the screwing and breaking apparatus of the iron roughneck 4.

Secured on the gripper seating 36 in FIGS. 4 and 5, at the respective ends, are an expansion cone 41, a cylinder 31, a receiving plate 46 for the gripping arms 38 and restoring springs 49, grippers 37 and rollers 48 for the gripper arms 38.

By initiating the movement of the cylinder 31, on the piston rod of which the expansion cone 41 is secured, the lower regions of the gripper arms 38 are pressed apart via the rollers 48 and the upper regions of the gripper arms 38 are moved together accordingly. The grippers 37 can generate sufficient force, via the lifting ratio of the gripper arm 38, to hold the pipe (not shown). The plate mountings 42 and 43 serve to receive the cylinders 32. In order to counter twisting of the tongs 34, reinforcing ribs 47, designed as junction plates, are provided. Other pipe-handling apparatuses can, of course, also be used.

Figure 7:
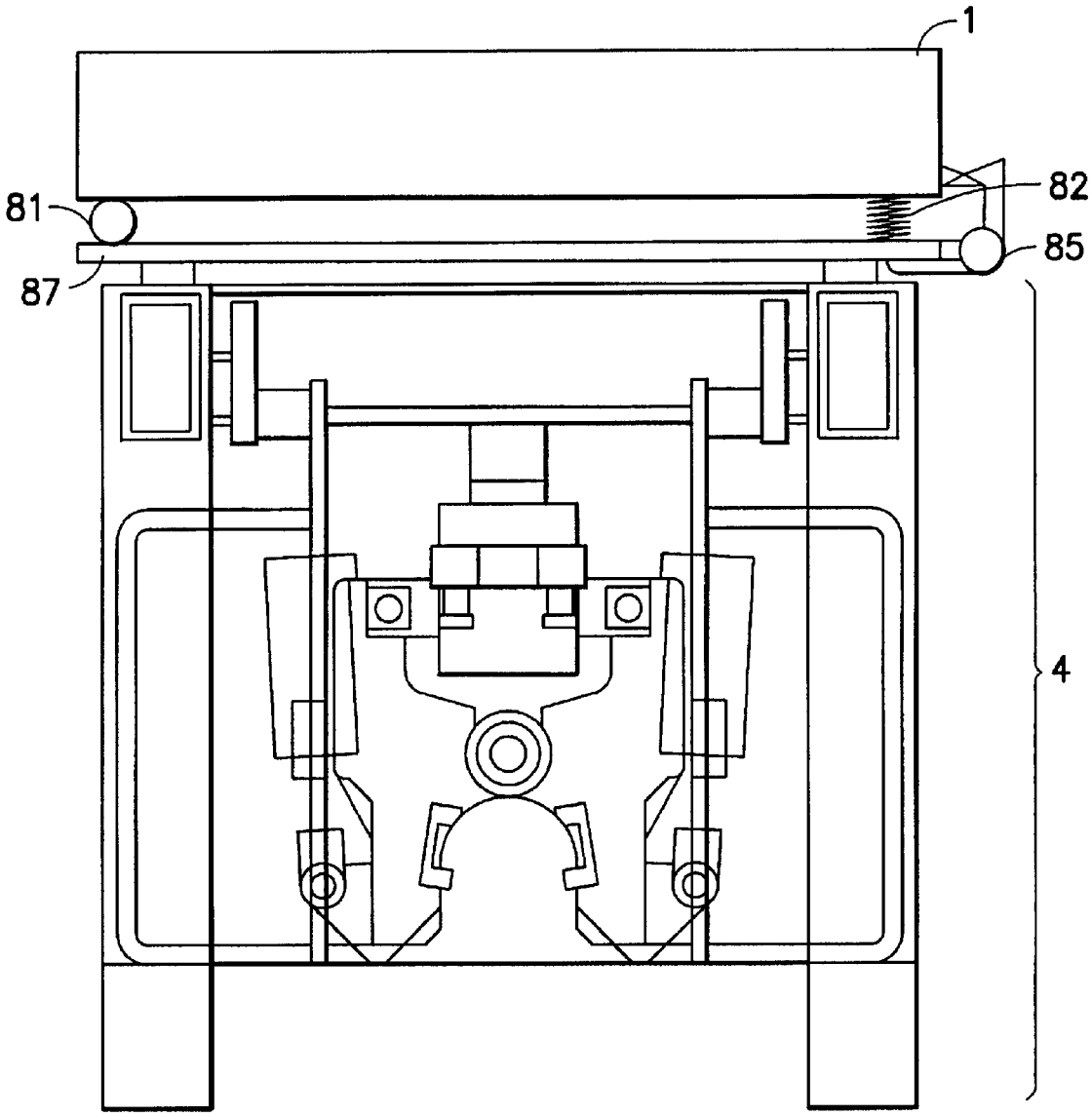
FIG. 7 shows the plan view of a roughneck.

FIG. 7 shows the plan view of a roughneck 4. This roughneck 4 is secured on a baseplate 87 and can be pivoted by means of a hinge 81.

The roughneck is secured on hinges 81, which are connected to the base 1, in order to permit the installation of down hole equipment. The roughneck is secured by a locking latch 89 with a lock in order to prevent pivoting away during drilling. The spacer 82 is located between the baseplate of the iron roughneck and the base 1 and simultaneously serves as a damping unit in the latched-in state.

In particular, in the embodiment of a drilling machine according to the invention which is only rotatable, the roughneck 4 need not be integrated into the base but can, for example, be arranged on the working platform.

Figure 8:
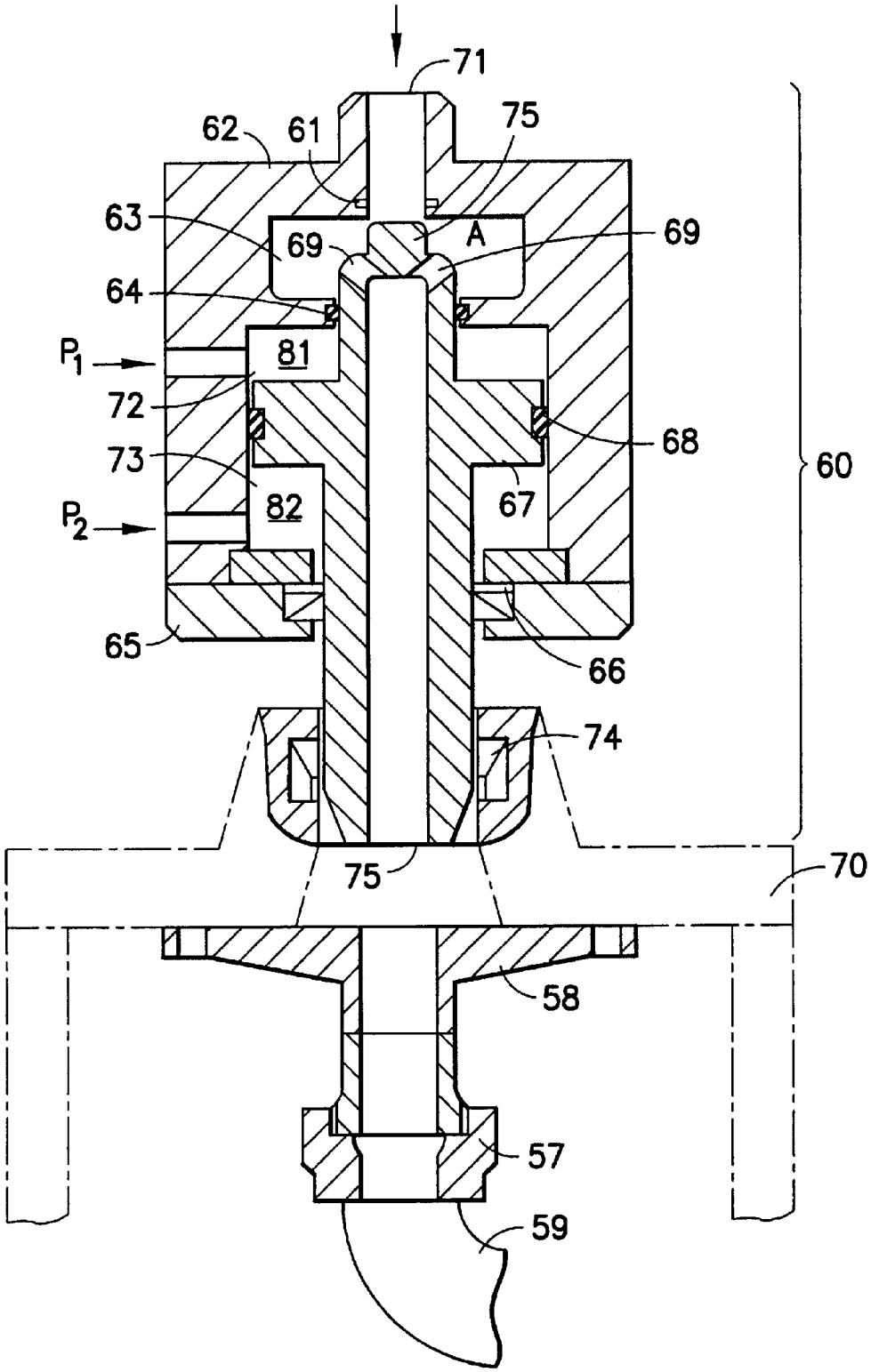
FIG. 8 shows a section through a locking apparatus with integrated flushing feed.

FIG. 8 shows, in a special example of embodiment, in the case of a base 1 which is combined with a steel structure, a locking apparatus with integrated flushing feed during the locking operation. This locking apparatus 60 consists of a base body 62, an internal hollow cylinder 67, a lid 65 and the seals 64, 66, 68. The volume flow of the flushing is passed through the upper aperture 71 on the base body (stator) 62. If the pressure $P_1$ exists in the control pressure chamber 72 and the hollow cylinder 67 is in a lower locking position, flushing can penetrate through the holes 69 into the interior space of the hollow cylinder 67 and be passed to the flushing hose, which is integrated in the base 1, through the aperture 75. The hollow cylinder is sealed by the seals 68, 66 and 64. The flushing hose, which leads to the flushing pump, is connected (not shown) to the aperture 71.

The stator 62 is divided into two regions and appropriate sealing of the regions is provided by the seal 64. The first region is the flushing pressure region (A) in the flushing space 63, and the second region consists of the control pressure chambers 72 and 73 (B1, B2). By controlling the pressure chamber (B1) 72 with $P_1$, the flushing is passed via the aperture 71 and simultaneously the base 1 is locked by introducing the hollow cylinder 67 into the entry lid 70. The entry lid 70 represents the topmost part of the base 1. The seal between locking device 60 and the entry lid 70 is provided by means of a seal 74. On the inside of the lid 70, the flushing connector hose 59 is connected by means of a connector 57 to a connecting or coupling piece 58. The connecting or coupling piece 58 is fixed on the lid 70. The flushing connector hose S9 leads to the flushing head.

By controlling the pressure chamber (B2) 73 with $P_2$, the base 1 is unlocked by moving the hollow cylinder 67 out of the entry lid 70 of the base 1 and flushing is interrupted, as the upper cam 75 of the hollow cylinder 67 can be introduced into the upper region of the stator 62 and flushing can be cut off by a seal 61 in the stator.

Figure 9:
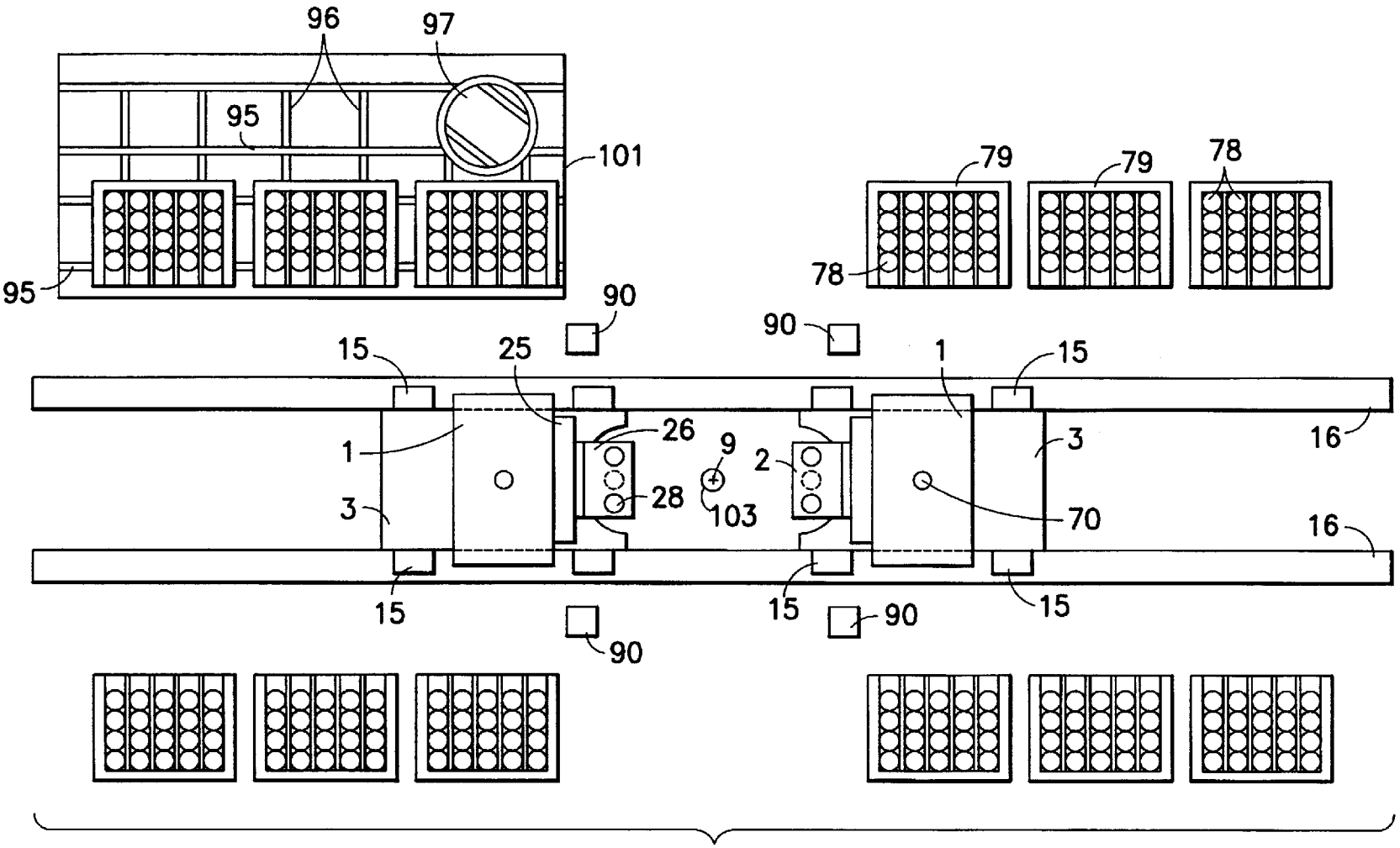
FIG. 9 shows the plan view of a drilling rig providing two opposite drilling machines.

FIG. 9 provides a sketched plan view of a drilling rig with two drilling machines. The use of two rockers or drilling machines has the advantage that, while one drilling machine is drilling, the other drilling machine can be charged with a new pipe 78 from the pipe rack 79 or prepared to be screwed to the pipes located in the well 103. The way in which a pipe 78 is gripped from the pipe rack 79 is that the rocker is rotated in the vertical position by approximately 90° via the rotational apparatus 6 and then grips a pipe 78 by means of the pipe-handling apparatus, which is arranged in the pipe-handling region 30 within the rocker 1, and is then rotated back again into the original position. By means of a movement apparatus 3, the whole rig can be moved in a linear guide means sufficiently far toward the well 103 for the pipe to be located above the center line 9. The movement apparatus is characterized by lateral rollers 15 which are guided on two rails 16. The corner pillars of a steel structure (not shown), into which the base 1 is locked by means of the lid 70, are designated 90. The movement apparatus 3 is, for example, dispensable if the base 1 is charged with the pipe in the horizontal position. Via the locking apparatus 6, which is shown in FIG. 8, the flushing is guided via the entry lid 70 into the pipe or well. After the drilling operation, the rocker is moved out of the well region by means of the movement apparatus 3, after the locking apparatus 60 has been released from the locking (not shown) of a steel structure. A skid, for example, can also be used as a movement apparatus.

The pipe racks 79 receive the pipe 78. They can be so designed that pipes of different lengths or different diameters can be placed in one seating. In this example of embodiment, three pipe racks 79, also described as seatings, are set upright on both sides of each drilling machine. A special embodiment of each unit comprising three pipe racks 79 is shown on the left-hand side. In this case, the pipe racks 79 are arranged standing on a sliding system comprising rails 95, 96. In this example, the transverse rails 96 are located below the longitudinal rails 95, which are arranged substantially parallel to the movement apparatus 3.

The seating 79 for the pipes can be displaced in two directions by means of this sliding system or can be interchanged with one another. The system is equipped with rails 95, 96 in both the longitudinal and transverse directions. The seatings have flanged rollers on their undersides, via which the linear movements can be reliably implemented. The changeover from the longitudinal to the transverse track can take place, in particular, via turntables 97 or a rotating disk or lifting devices (not shown). In the turntable embodiment, the seating stands on a rail system which is installed on a rotating apparatus. The seating is turned by means of a turntable to move it from the longitudinal to the transverse direction. The seating can now roll into a rearward position. In order to return to the longitudinal direction, it is again turned by means of a turntable.

A further embodiment is a lifting device below the transverse conveying rails 96. The seating is displaced longitudinally. In the changeover position from longitudinal to transverse, the transverse rail is raised. The longitudinal rollers lift off the rail 95, and the transverse rollers settle on the transverse rail 96. Now the seating can be rolled onto the rearward track comprising two longitudinal rails 95.

The seating 79 has longitudinal and transverse rollers (not shown), which are vertically offset in order to be able to be independent of one another in the rail system.

Figure 10:
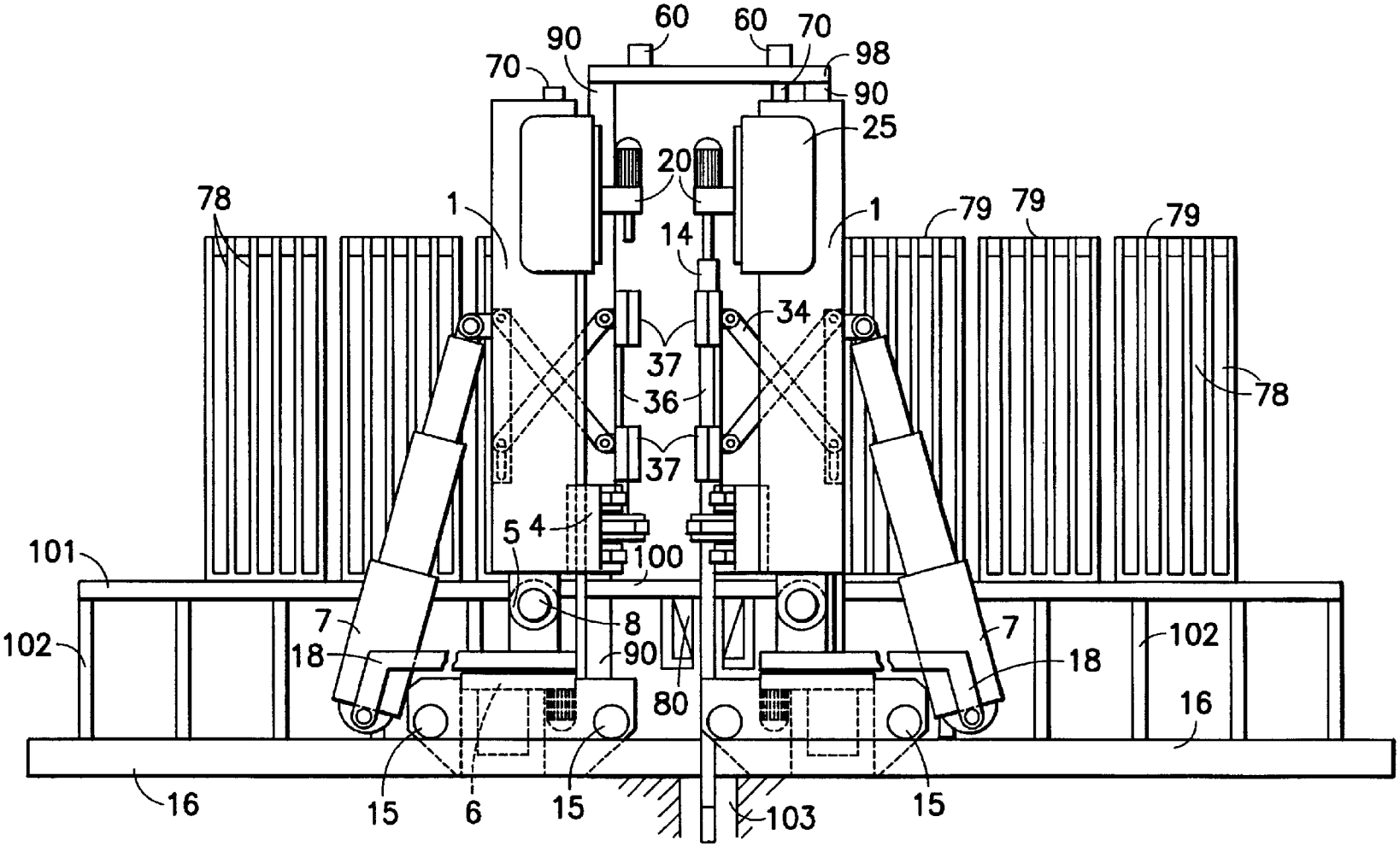
FIG. 10 shows a lateral view of a drilling rig according to the invention with two drilling machines.

FIG. 10 shows a lateral view of an example of embodiment of a drilling rig according to the invention in the sinking of a well with a steel structure.

The steel structure consists of corner pillars 90, only the rear pair being shown here, and a connecting or covering plate 98, which connects the corner pillars 90 to one another and gives stability to the steel structure. In addition, the locking apparatus 60 is fixed thereto and can be used to lock a drilling machine to the entry lid 70 of the base. The necessary flushing hoses are not shown. The connecting plate 98 can also consist of steel girders fixedly connected to one another. The corner pillars 90 can also be constructed from steel sections connected to one another. Also, the steel structure can be assembled from two, three or more corner pillars 90.

A working platform or stage 100 can, as in this example of embodiment, be arranged on the steel structure between the corner pillars, and is located approximately at the height of the live ring 6 or the swivel apparatus 5. Fixed to the working stage 100 is an apparatus which receives the retaining wedges 80. These serve to secure or hold the pipe located in the well 103 during the loading of new pipes 78 from the pipe store 79.

The roughneck 4 is arranged, in FIG. 10, on the base 1 and specifically in the lower region. In an alternative embodiment of the drilling rig (not shown), the roughneck is arranged not on the base but on the working stage 100.

The two bases 1 have simplified pipe-handling apparatuses 30, with which no lifting movement can be carried out. Such an arrangement is also necessary, for example, if, when the pipe racks 79 are standing upright, fingers which serve to retain or lock the pipes 78 are arranged to be movable vertically. In the normal case, however, pipe-handling apparatuses 30 are used which can perform lifting movements.

The pipe racks or pipe seating 79 are placed side by side on a stage 101. They are filled with pipes 78.

The bases 1 can be displaced via the movement apparatus 3 by means of the rollers 15 on rails 16 along the stage 101. The bases 1 are also mounted to be rotatable via live rings 6, in order to perform a 90° rotation, for example to remove a pipe 78 from the pipe rack 79. The swivel apparatus 5 and the elevator 7 are dispensable in this case. It may be used, however, if oblique drilling is to take place at another drilling location, for example using only one drilling machine, or when the base 1 is to be erected for the first time.

FIG. 10 shows the right-hand drilling machine shortly before the drilling operation, where, for reasons of improved stability, it is releasably connected to the steel structure via the entry lid 70 and the locking apparatus 60. The drill rod 14 is already in the well 103, but the pipe-handling apparatus 30 has not yet been moved into the base. The second, left-hand drilling machine travels on the rails 16 directly backward, in other words away from the well (toward the left in the illustration), in order to load a new drill rod 78 from the pipe rack 79 by means of the pipe-handling apparatus 30. The locking in the steel structure is released.

Figure 11:
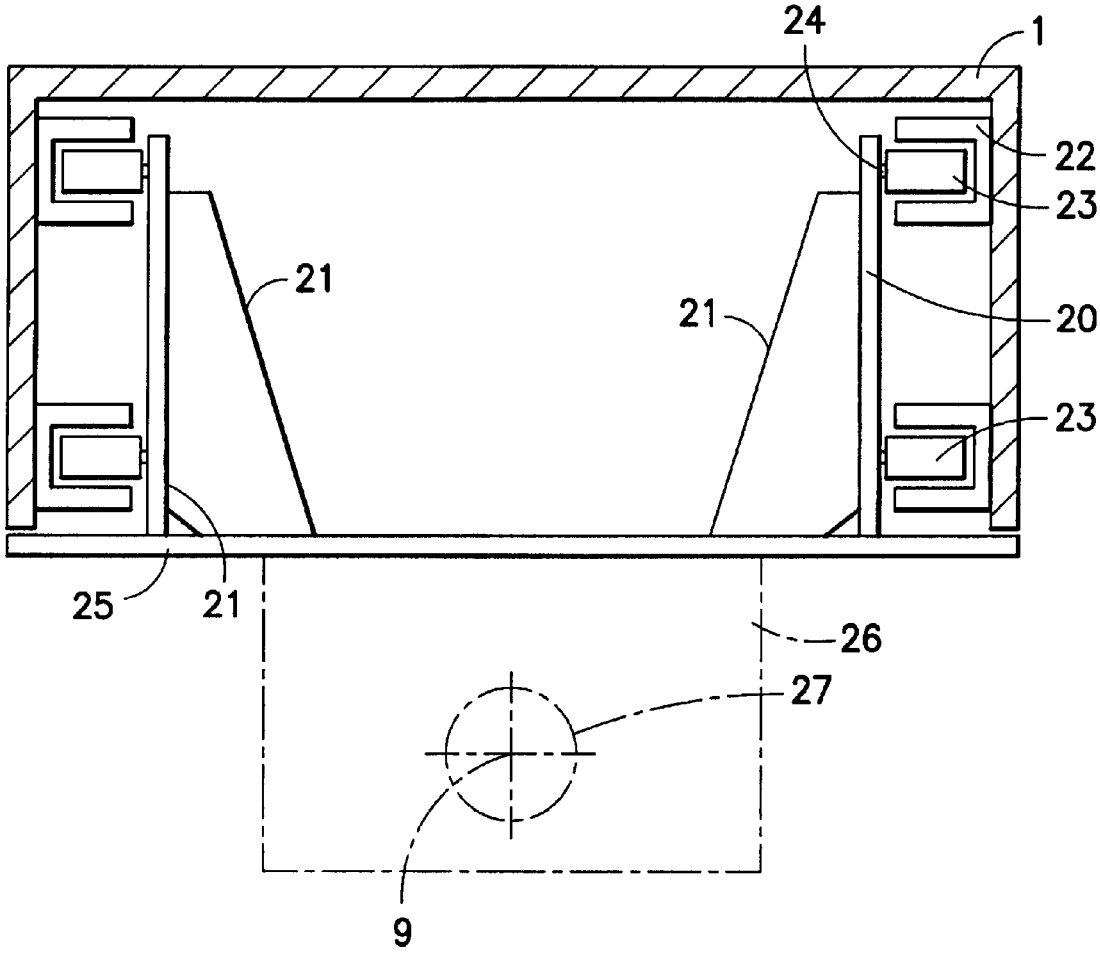
FIG. 11 shows a further example of embodiment of a guide means of the top drive in the base 1.

FIG. 11 describes another example of embodiment of a top drive guide means, in which the guide means is arranged within the base 1. In this alternative embodiment, guide rails 22 are mounted in the base, and serve by means of the guide rollers 23 to receive the lateral guide plates 20. The rollers 23 for the axial movement are mounted on these lateral guide plates 20. These guide rollers 23 are, for example, roller-mounted and guide the complete structure in the linear axis. Junction plates 21 are welded onto the lateral guide plates 20 and serve to reinforce the receiving plates. The receiving plate 25 for the top drive is mounted on this welded structure. With the aid of a linear drive, a linear movement can be performed by the above-mentioned arrangement. This linear drive can be driven by chains, cables or a fluid engineering (hydraulic, pneumatic, etc.) solution.

A further embodiment according to the invention (not shown) envisages that a pipe-handling apparatus is arranged not directly on the base (1) but on the top drive housing (26) or the receiving plate (25) for the top drive housing (26) and moves with the latter coaxially to the longitudinal axis of the base (1).

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A drilling machine, comprising: a base having a foot and a longitudinal axis; a top drive arranged one of on and in the base so as to be displaceable axially to the longitudinal axis of the base; and a pipe-handling apparatus integrated in the base so as to be movable perpendicularly to the longitudinal axis of the base and which grips a drilling pipe, the base being pivotably and rotatably mounted in a region of the foot such that the base is pivotal from a substantially vertical position toward a horizontal position and is rotatable about the longitudinal axis of the base in the substantially vertical position.

2. A drilling machine as defmed in claim 1, and further comprising a power roughneck arranged below the pipe-handling apparatus, the power roughneck including a holder and a breaking and securing apparatus.

3. A drilling machine as defmed in claim 2, wherein the breaking and securing apparatus is arranged in the base and the holder is arranged one of in and under a working stage.

4. A drilling machine as defined in claim 2, and further comprising a hinge arranged to connect the roughneck pivotably to the base by a hinge, the hinge being arranged on one side of the roughneck.

5. A drilling apparatus as defmed in claim, 1, wherein the drilling machine is configured to be horizontally slidable.

6. A drilling apparatus as defined in claim 1, and further comprising a steel structure, and a locking apparatus arranged at an upper end of the base and connected to the steel structure.

7. A drilling apparatus as defined in claim 6, wherein the steel structure is one of a tower and a mast.

8. A drilling machine as defined in claim 6, wherein the steel structure has a working stage, at least one of the rotation point and a pivot point of the base being arranged one of above and below the working stage.

9. A damping A drilling machine as defined in claim 6, and further comprising a damping device arranged on at least one of the base and the steel structure.

10. A drilling machine as defined in claim 6, wherein part of the steel structure is designed as one of pipe rack and a seating for a pipe holder.

11. A drilling machine as defined in claim 10, wherein the steel structure has at least one corner pillar, the at least one corner pillar being formed as one of the pipe rack and the seating for a pipe holder.

12. A drilling machine as defmed in claim 10, wherein the pipe rack is rotatable about its longitudinal axis.

13. A drilling machine as defined in claim 1, and further comprising an elevator operatively arranged to raise the base from horizontal to vertical.

14. A drilling machine as defined in claim 13, wherein the elevator includes at least one working cylinder.

15. A drilling machine as defined in claim 14, wherein the working cylinder is one of a hydraulic cylinder and a pneumatic cylinder.

16. A drilling machine as defined in claim 1, and further comprising a linear apparatus arranged one of in and on the base via which the top drive is displaceable.

17. A drilling machine as defined in claim 1, and further comprising a pipe rack arranged within range of the pipe-handling apparatus, individual pipes being arranged standing in the pipe rack.

18. A drilling machine as defined in claim 17, and further comprising a vehicle, at least one of the drilling machine and the pipe rack being mounted on the vehicle.

19. A drilling machine as defmed in claim 17, and further comprising a trailer, at least one of the drilling machine and the pipe rack being mounted on the trailer.

20. A drilling machine as defined in claim 1, wherein the pipe-handling apparatus includes grippers and a gripper seating, at least one of the pipe-handling apparatus, the grippers and the gripper sealing being displaceable axially to the longitudinal axis of the base.

21. A drilling rig, comprising at least two drilling machines arranged so as to be alternatingly one of movable, rotatable and pivotable over a center line of a well, each of the drilling machines including a base having a foot and a longitudinal axis, a top drive arranged one of on and in the base so as to be displaceable axially to the longitudinal axis of the base, and a pipe-handling apparatus arranged one of on and in the base so as to be movable perpendicularly to the longitudinal axis of the base and which grips a drilling pipe, the base being at least one of pivotably and rotatably mounted in a region of the foot.

22. A drilling rig as defined in claim 21, wherein the two drilling machines are arranged approximately symmetrically to the center line, the drilling machines being connected to one another.

23. A drilling rig as defined in claims 22, wherein a connection between the drilling machines is provided by a substantially kinematic chain.

24. A drilling rig as defined in claim 23, wherein the kinematic chain is one of a cable and a chain.

25. A drilling rig as defined in claim 22, and further comprising a steel structure to which the steel structure is arranged between the two drilling machines, the drilling machines being reciprocally lockable, one of a cable and a chain being arranged to connect the drilling machines via one of a return point and a return roller arranged in the steel structure.

26. A drilling rig as defined in claim 25, and further comprising support devices for one of the drilling and the steel structure, and a damping device arranged on the support devices.

27. A drilling rig as defined in claim 26, wherein the damping device includes a hydraulic cylinder and a choke.

28. A method for sinking a well, comprising the steps of:

a) rolling a pipe onto a base of a drilling machine, a top drive being in an upper position and grippers of a pipe-handling apparatus being moved into the base;

b) gripping the pipe with the pipe-handling apparatus as soon as the pipe is lying in an intended position o the base;

c) subsequently raising the base by means of an elevator from a horizontal position into a position between 5° and 90°;

d) during the raising of the base, screwing the top drive to the pipe by a drive shaft of the top drive, securing the top drive and then moving the top drive one of with the pipe-handling apparatus and by means of a linear drive into an upper region of a roughneck, grasping a lower pipe connector of the pipe with a breaking and securing apparatus of the roughneck holding the string;

e) screwing the pipe with one of the top drive and the roughneck to a drilling string within the well; and f) again moving the pipe-handling apparatus into the base and the holder for the lower pipe, connected to a drill bit, opening the pipe-handling apparatus and beginning a drilling operation, the top drive being lowered in a guide means of the base.

29. A method as defined in claim 28, wherein the base raising step includes raising the base by means of an elevator into a substantially vertical position, and then locking the base in a steel structure when this position is reached, steps d) through f) being carried out after the base has been locked.

30. A method as defmed in claim 28, including displacing the base horizontally after removal of the pipe and its preparation for drilling and before being screwed to the lower pipe in the well.

31. A method for sinking a well by means of a drilling machine having a base having a foot and a longitudinal axis, a top drive arranged one of on and in the base so as to be displaceable axially to the longitudinal axis of the base, and a pipe-handling apparatus integrated in the base so as to be movable perpendicularly to the longitudinal axis of the base and which grips a drilling pipe, the base being pivotably and rotatably mounted in a region of the foot such that the base is pivotal from a substantially vertical position toward a horizontal position and is rotatable about the longitudinal axis of the base in the substantially vertical position, the method comprising the steps of removing a pipe From a pipe rack, in which the drilling pipe is arranged vertically, by means of the pipe-handling apparatus, which is integrated into the drilling machine; screwing the pipe to the top drive by means of the pipe-handling apparatus; and bringing the pipe into a drilling position.

32. A method as defined in claim 31, including rotating the pipe rack, after removal of a pipe by the pipe-handling apparatus, sufficiently far about its own longitudinal axis for it to be possible for a next pipe in the pipe rack to be gripped by the pipe-handling apparatus.

33. A method as defined in claim 31, including rotating the drilling machine, after completion of a drilling section and release of the top drive from a drilling string in the well, about its longitudinal axis and then, after the top drive has been raised, removing a new pipe from the pipe rack by means of the pipe-handling apparatus.

34. A drilling machine, comprising: a base having a foot and a longitudinal axis; a top drive arranged one of on and in the base so as to be displaceable axially to the longitudinal axis of the base; a pipe-handling apparatus arranged one of on and in the base so as to be movable perpendicularly to the longitudinal axis of the base and which grips a drilling pipe, the base being at least one of pivotably and rotatably mounted in a region of the foot; a steel structure; and a locking apparatus arranged at an upper end of the base and connected to the steel structure, the locking apparatus including a hollow cylinder, a flushing hose connected to the hollow and a valve arranged to ensure flushing feed.

35. A drilling machine as defined in claim 34, and further comprising a drum arranged one of on and in the base so that the flushing hose is rollable onto the drum.

36. A drilling machine as defined in claim 34, wherein the top drive includes an integrated flushing head, and further comprising a flushing pump, and a line for flushing provided one of on and in the base, the line including a lower connector connected to the integrated flushing head of the top drive and an upper connector connected via the hollow cylinder to the flushing hose leading to the flushing pump.

37. A drilling machine, comprising: a base having a foot and a longitudinal axis; a top drive arranged one of on and in the base so as to be displaceable axially to the longitudinal axis of the base; a pipe-handling apparatus arranged one of on and in the base so as to be movable perpendicularly to the longitudinal axis of the base and which grips a drilling pipe, the base being at least one of pivotably and rotatably mounted in a region of the foot; and an elevator operatively arranged to raise the base from horizontal to vertical, the elevator including a winch.

38. A drilling machine, comprising: a base having a foot and a longitudinal axis; a top drive arranged one of on and in the base so as to be displaceable axially to the longitudinal axis of the base; a pipe-handling apparatus arranged on of one and in the base so as to be movable perpendicularly to the longitudinal axis of the base and which grips a drilling pipe, the base being at least one of pivotably and rotatably mounted in a region of the foot; and a power rough neck arranged below the pipe handling apparatus, the power rough neck including a holder and a breaking and securing apparatus, the rough neck being connected to the base so as to be displaceable perpendicularly to the axis of the base and raisable by the top drive via a coupling.

39. A method for sinking a well by means of a drilling machine having a base having a foot and a longitudinal axis, a top drive arranged one of on and in the base so as to be displaceable axially to the longitudinal axis of the base, and a pipe-handling apparatus arranged one of on and in the base so as to be movable perpendicularly to the longitudinal axis of the base and which grips a drilling pipe, the base being at least one of pivotably and rotatably mounted in a region of the foot, the method comprising the steps of: removing a pipe from a pipe rack, in which the drilling pipe is arranged vertically, by means of the pipe-handling apparatus, which is integrated into the drilling machine; screwing the pipe to the top drive by means of the pipe-handling apparatus; and bringing the pipe a drilling position, further including bringing at least two drilling machines into position around a well, sinking one drilling pipe in alternation while at least one of the drilling machine is prepared for drilling by receiving a further pipe.

40. A method for sinking a well by means of a drilling machine having a base having a foot and a longitudinal axis, a top drive arranged one of on and in the base so as to be displaceable axially to the longitudinal axis of the base, and a pipe-handling apparatus arranged one of on and in the base so as to be movable perpendicularly to the longitudinal axis of the base and which grips a drilling pipe, the base being at least one of pivotably and rotatably mounted in a region of the foot, the method comprising the steps of: removing a pipe from a pipe rack, in which the drilling pipe is arranged vertically, by means of the pipe-handling apparatus, which is integrated into the drilling machine; screwing the pipe to the top drive by means of the pipe-handling apparatus; and bringing the pipe a drilling position, further including removing a pipe from the pipe rack while simultaneously charging the pipe rack with further pipes.

* * * * *